United States Patent [19]

Guay

[11] 4,259,107

[45] Mar. 31, 1981

[54] RECOVERY OF GOLD FROM SEDIMENTARY GOLD-BEARING ORES

[75] Inventor: Wilbur J. Guay, Newtown, Conn.

[73] Assignee: Newmont Exploration Limited, Conn.

[21] Appl. No.: 103,189

[22] Filed: Dec. 13, 1979

[51] Int. Cl.[3] ..... C22B 11/08

[52] U.S. Cl. ..... 75/105; 75/106; 75/107; 75/118 R; 423/29

[58] Field of Search ..... 75/105, 106, 107, 118 R; 423/29

[56] References Cited

U.S. PATENT DOCUMENTS

| | | | |
|---|---|---|---|
| 636,114 | 10/1899 | Cain et al. | 423/29 |
| 692,634 | 2/1902 | Davis | 75/112 X |
| 1,071,791 | 9/1913 | Pugsley | 423/34 |
| 3,574,600 | 4/1971 | Scheiner | 75/105 |
| 3,846,124 | 11/1974 | Guay | 75/118 R X |
| 4,038,362 | 7/1977 | Guay | 423/29 X |

OTHER PUBLICATIONS

*Merck Index,* Seventh Edn., Merck & Co., N.J., 1960, p. 548.

Schlesinger, *General Chemistry,* 4th Edn., Longmans, Green & Co., N.Y., 1953, pp. 422 & 423.

*Primary Examiner*—G. Ozaki

*Attorney, Agent, or Firm*—Pennie & Edmonds

[57] ABSTRACT

Gold-bearing ore of sedimentary origin containing organic carbonaceous material and gold-bearing sulfides is treated to increase the recovery of the gold content thereof by standard cyanidation practice. An aqueous slurry of the finely ground ore is first subjected to a preliminary oxidation treatment wherein air or oxygen is bubbled through the slurry while maintaining the slurry at a temperature of from 167° to 212° F. for a period of from 8 to 24 hours. The oxygenated slurry is then cooled to a temperature of from 70° to 125° F. and acid is added to bring the pH of the slurry down to 6.0 of lower. Chlorine gas or an alkali metal or alkaline earth metal hypochlorite is then added to the slurry unitl the slurry will no longer absorb or react with these reagents. The thus treated slurry is maintained at a temperature of from 70° to 125° F. for a period of from 6 to 12 hours. The solids content of the slurry is then subjected to standard cyanidation, recovery of at least 75% of the gold content of the ore being obtained.

5 Claims, No Drawings

RECOVERY OF GOLD FROM SEDIMENTARY GOLD-BEARING ORES

TECHNICAL FIELD

This invention relates to the recovery of gold from gold-bearing ores of sedimentary origin which are characterized by a significant content of organic carbonaceous and sulfidic mineral materials.

BACKGROUND ART

Sedimentary gold-bearing ores containing indigenous organic carbonaceous material and gold-bearing sulfidic minerals are notoriously refractory to standard cyanidation treatment for the recovery of their gold content. Investigation into the cause of this problem has indicated that the carbonaceous materials comprises active carbon and long-chain organic compounds. The active carbon appears to absorb the gold cyanide complex $[Au(CN)_2-]$ from cyanide leaching solutions and the long-chain organic compounds appears to form stable complexes with the gold. In addition, some of these ores also contain gold-bearing sulfides. The sulfides contain gold either as a mechanical inclusion, or as atoms of gold included in the sulfide crystal lattice.

In order to overcome this sequestering of the gold and to render the gold component of the ore more amenable to standard cyanidation treatment it has heretofore been proposed that the ore be subjected to a preliminary oxidation treatment to oxidize the carbonaceous, sulfidic mineral materials, and as much of the carbonaceous mineral materials as can be oxidized. In experiments conducted by the United States Bureau of Mines, alkaline slurries of carbonaceous gold-bearing ores were subjected to a preliminary oxidation with a wide variety of reagents including ozone, sodium hypochlorite, calcium hypochlorite, permanganates, perchlorates, chlorates and oxygen prior to subjecting the oxidized ore to standard cyanidation treatment to extract the gold content therefrom. Of these treatments, the hypochlorites appeared to be the most effective, although it was found that an elevated temperature was required to obtain satisfactory results. At room temperature (about 70° F.) the hypochlorite treatment required several days to make the gold content of the ore available for recovery by cyanidation while temperatures above about 140° F. caused premature decomposition of the hypochlorites. Consequently, it was determined that a temperature within the range of about 122° to 140° F. was required to render the gold component of the ore amenable to standard cyanidation treatment.

In U.S. Pat. No. 3,846,124 to Wilbur J. Guay it was shown that the recoverability, by standard cyanidation, of the gold content of carbon-containing sedimentary gold bearing ores is increased by subjecting the ore to a preliminary oxidation and chlorination treatment in which chlorine gas is introduced into an aqueous slurry of the ground ore having a pH of about 8 to the extent that the slurry will absorb the chlorine, the thus treated slurry being maintained at the chlorination treatment temperature of about 70° to 85° F. for at least 6 hours. The oxidized ore is then subjected to standard cyanidation to extract the gold content therefrom with gold recoveries in the order of 75% or more of the gold content of the ore.

In U.S. Pat. No. 4,038,362 to Wilbur J. Guay it was shown that the recoverability, by standard cyanidation, of the gold content of sedimentary gold-bearing ores containing organic carbonaceous material and gold-bearing pyrite, or other gold-bearing sulfides, is increased and the cost of the pretreatment greatly reduced by subjecting the ore to a two-stage preliminary oxidation and chlorination treatment. In this process an aqueous slurry of the ore is first heated to about 167° to 212° F., and air or oxygen is introduced into the heated slurry to oxidize and eliminate a substantial portion of the carbonaceous material and oxidizable sulfides in the slurried ore. The slurry is then cooled to about 70° to 85° F., and chlorine gas is introduced into the slurry at a pH of 8 or higher to substantially complete the oxidation and chlorination of the carbonaceous and sulfide content of the slurried ore. The oxidized ore is then subjected to conventional cyanidation to recover the gold content thereof.

I have now discovered that the recoverability of gold from the ore is enhanced by the addition of acid to the aqueous slurry of the ore to reduce the pH of the slurry to 6.0 or less following the first or oxidation stage and prior to the chlorination stage of the preliminary two-stage treatment of the ore. I have also discovered that the acidification of the slurry permits the chlorination stage of the preliminary treatment of the ore to be carried out at a temperature of from 70° to 125° F., as compared to 70° to 85° F. previously required, and I have also found that the acidification of the ore slurry significantly increases the rate at which sodium hypochlorite will react with carbonaceous and sulfidic constituents of the ore at temperatures within this range so as to make it feasible to use sodium hypochlorite as an alternative to chlorine in the chlorination stage of the process.

SUMMARY OF THE INVENTION

Pursuant to the present invention a finely ground sedimentary gold-bearing ore containing organic carbonaceous and sulfidic mineral materials is slurried with water and the resulting slurry containing no extraneous alkaline material is heated to a temperature in the range of about 167° to 212° F. The heated slurry is then treated with as much oxygen as it will absorb, either by bubbling air or oxygen into the ore slurry, this treatment requiring from 8 to 24 hours for maximum oxidation by air. The slurry is then cooled to a temperature within the range of about 70° to 125° F. and a mineral acid is added to the slurry to bring the pH of the slurry down from about 8.0 or higher to about 6.0 or lower. The acidified slurry is then treated with chlorine or sodium hypochlorite by adding as much of either one or the other of these reagents to the slurry as the slurry will absorb while at a temperature within the aforementioned range, the slurry being held at this temperature for a period of about 6 to 12 hours while the chlorine or hypochlorite digestion proceeds to completion. The oxidized and chlorinated ore is then subjected to standard cyanidation to recover at least about 75% by weight of the gold content of the ore.

In the processes for the treatment of sedimentary gold-bearing ores disclosed in U.S. Pat. Nos. 3,846,124 and 4,038,362 the pH of the slurried ore is about 8.0 or higher at the beginning of the chlorine treatment of the ore, the pH of the slurry decreasing to about 6.0 as the chlorine treatment procedes to completion. In the Bureau of Mines process the pH of the slurried ore is also at 8.0 or higher at the beginning of the hypochlorite treatment of the ore and it remains at a high level throughout the treatment. By adjusting the pH of the slurried ore to about 6.0 or less at the beginning of the chlorine or hypochlorite treatment the treatment can be carried out at a higher than usual temperature in the case of chlorine and at a lower than usual temperature in the case of hypochlorite with a concomitant increase in the efficiency and effectiveness of the pretreatment of the ore by means of the process of the invention.

BEST MODE FOR CARRYING OUT THE INVENTION

The sedimentary gold-bearing ore to which the present invention relates typically contains from about 0.1 to 1.0 ounces of gold per ton of ore, from about 0.1 to 5.0% by weight of carbon and up to about 2.0% by weight of pyritic materials, a substantial portion of the gold being present in the form of organic carbonaceous compounds and gold-bearing mineral sulfide materials. The ore is prepared for treatment pursuant to the invention by wet grinding the crushed ore to about 60 weight percent minus 200 mesh (Tyler Standard Screen) with sufficient water so that it will form a slurry with about 40 to 50% solids in water. Preferably, no extraneous components are used in forming this slurry, including extraneous alkaline materials, so that it will have a pH ranging between 6 and 10, and usually 8.0 or higher, resulting solely from the slurrying of only the ore with water.

The resulting slurry is heated to a temperature within the range of 167° to 212° F. by conventional means. Air, or oxygen, is then dispersed through the heated slurry, advantageously by bubbling it into the bottom of the slurry mass by any conventional and appropriate device at a rate such that it will be present in excess of the amount required for the reaction with the carbonaceous compound and gold-bearing sulfides. Generally, this bubbling of the air or oxygen into the slurry will be accompanied by sufficient agitation to insure uniform exposure of the ore to the action of the air, or oxygen. The reaction between the oxygen and the carbonaceous component of the ore results in the evolution of carbon dioxide, nitrogen, and excess oxygen from the slurried ore. This reaction between oxygen and the gold-bearing sulfides results in chemical compounds that remain in the slurry. The bubbling is continued for a period of from 8 to 24 hours or until no further oxidation of carbonaceous compounds or gold-bearing sulfides by air, or oxygen, is being effected.

The slurry is then cooled by conventional means to a temperature within the range of 70° to 125° F. Acid is then added to the slurry to bring the pH of the slurry down to 6.0 or lower, the added acid preferably being a dilute mineral acid such as sulfuric, hydrochloric, or nitric acid. Chlorine gas is then dispersed through the slurry, advantageously by bubbling it into the bottom of the slurry mass by any conventional and appropriate device at a rate such that it will be substantially completely absorbed by the slurry. Generally, this bubbling of the chlorine into the slurry provides sufficient agitation to insure uniform exposure of the ore to the action of the chlorine, although additional mechanical agitation is advantageous. As the chlorination of the slurry proceeds a gas consisting primarily of carbon dioxide, nitrogen, and oxygen is evolved from the slurry, the addition of chlorine to the slurry being terminated when the slurry will no longer react with the chlorine as evidenced by the presence of significant amount of chlorine in the gas evolved from the slurry. Alternatively, an alkali metal or alkaline earth metal hypochlorite is added to the slurry while the temperature is maintained within the range of 70° to 124° F., the hypochlorite being added to the slurry by any appropriate device at a rate such that it will be substantially completely absorbed by the slurry. The adjustment of the pH of the slurry to 6.0 or lower can be made either before or after the addition of the hypochlorite to the slurry. As the hypochlorite treatment proceeds, there is evolved from the slurry a gas consisting primarily of carbon dioxide, nitrogen, and oxygen, the hypochlorite addition being terminated when the slurry will no longer react with this reagent with consequent build-up of hypochlorite in the slurry. The evidence of the build-up of hypochlorite is advantageously determined by titration of the slurry with sodium thiosulfate solution.

Upon completion of the addition of the chlorine or hypochlorite to the slurry, the slurry is held at a temperature within the aforementioned range, without further additions of chlorine or hypochlorite, for a period of at least six hours, and preferably for a period of between 6 and 12 hours. During this period, the reaction mass equilibrates with resulting passivation or alteration of the carbonaceous content of the ore so that it will not significantly sequester the gold content of the ore when the thus-treated ore is subsequently subjected to standard cyanidation. Where the ambient temperature during this holding period drops below the aforementioned range of 70° to 125° F., heat is added to the reaction mass by any conventional means in order to hold the temperature of the mass within this range.

The following examples are illustrative, but not limitative, of practice of the invention:

EXAMPLE I

A random mass of organic carbon-containing sedimentary gold-bearing ore from Carlin, Nevada, which contained about 0.47 ounces of gold per ton, about 1% pyrite ($FeS_2$), and 4.3% total carbon (about 0.7% carbon in the organic form), was crushed to minus 10 mesh (Tyler) and then was wet ground with water (60% ore, 40% water, by weight) to yield an aqueous slurry containing the ore approximately 60% of which was minus 200 mesh particle size. The ground ore slurry or pulp was then transferred to an open vessel where it was continuously stirred while water was added to adjust the pulp to between 40 and 50% by weight of solids. The slurry was heated to a temperature within the range of about 200° to 210° F., and was maintained at this temperature for 8 hours. Oxygen was bubbled through the heated slurry at the rate of 0.1 liters per minute (STP) for 8 hours with the concomitant evolution of carbon dioxide, nitrogen and excess oxygen from the slurry, indicating that a substantial portion of the organic carbonaceous component of the ore had been oxidized and eliminated from the slurry. The slurry was then cooled to a temperature to within 80° to 85° F. and was maintained at this temperature for 8 hours. A dilute solution of sulfuric acid was added to bring the pH of the slurry to 6.0. Chlorine was bubbled into and dispersed through the slurry for 8 hours for a total amount of 50 pounds of chlorine per ton of slurried ore. The slurry was then filtered and the filter cake washed with fresh water. The solids were then repulped with fresh water and cyanided for 16 hours to extract the gold. An extraction of 84.0% of the gold was achieved. An identical sample of the same lot of ore required 86 lb of chlorine per ton of ore to give 84.0% gold extraction by cyanidation using the method of U.S. Pat. No. 4,038,362 and 206 lb of chlorine per ton of ore to give 84.0% gold extraction by cyanidation using the method of U.S. Pat. No. 3,846,124. The chlorine requirement was thus reduced from 86 lb per ton of ore to 50 lb per ton of ore, a reduction of 41.9%.

EXAMPLE II

A random mass of the same organic carbon-containing sedimentary gold-bearing ore was crushed to a minus 10 mesh (Tyler) and then was wet ground with water (60% ore, 40% water) to yield an aqueous slurry containing the ore approximately 60% of which was minus 200 mesh particle size. The ground ore slurry or pulp was then transferred to an open vessel where it was continuously stirred while water was added to adjust the pulp to between 40 and 50% by weight of solids. The slurry was heated to a temperature within the range of about 200° to 210° F. and was maintained at this temperature for 8 hours. Oxygen was bubbled through the heated slurry at the rate of 0.1 liters per minute (STP) for 8 hours with the concomitant evolution of carbon dioxide, nitrogen, and excess oxygen from the slurry, indicating that a substantial portion of the organic carbonaceous components of the ore had been oxidized and eliminated from the slurry. The slurry was then cooled to a temperature within the range of 70° to 125° F., and a dilute solution of sulfuric acid was added to bring the pH of the slurry to 6.0. Sodium hypochlorite was then added to the slurry over a period of about 10 minutes for a total of 71 lb of sodium hypochlorite per ton of the slurried ore, and the thus treated slurry was held at a temperature within the aforementioned range for 8 hours. The slurry was then filtered and the filer cake washed with fresh water. The solids were then repulped with fresh water and cyanided for 16 hours to extract the gold. An extraction of 85.0% of the gold was achieved. An identical sample of the same lot of ore required 110 lb of sodium hypochlorite pretreatment to give 85.0% gold extraction by cyanidation using nearly identical procedures except that the pH was not adjusted after the aeration procedure, the final pH after hypochlorite treatment being above 10.0. The hypochlorite requirement was thus reduced from 110 lb per ton of ore to 71 lb per ton of ore, a saving of 35.5%, by lowering the pH to 6.0.

EXAMPLE III

The oxidation and cyanidation treatment described in Example II was repeated using the same procedures as in Example II except that the oxidized slurry was treated with calcium hypochlorite instead of sodium hypochlorite, the hypochlorite consumption and gold recovery being essentially the same as that of Example II.

I claim:

1. The method for treating sedimentary gold-bearing ore containing indigenous organic carbonaceous material and gold-bearing sulfides so as to increase the recoverability of its gold content by standard cyanidation extraction which comprises: slurrying the ore with water in the absence of extraneous alkaline material; adjusting the temperature of the slurry to about 167° to 212° F.; dispersing air or oxygen throughout the slurry at a rate and for a period of time such as the slurry will continue to absorb oxygen and the oxygen reacts with the organic carbonaceous and the sulfide content of the ore; maintaining the oxygenated slurry at a temperature of from about 167° to 212°F. for about 8 to 24 hours; adjusting the temperature of the slurry to about 75° to 125° F.; adding a mineral acid to the slurry to bring the pH of the slurry to 6.0 or lower; introducing a chlorinating agent selected from the group consisting of chlorine, alkali metal hypochlorites and alkaline earth metal hypochlorites into the slurry at a rate and for a period of time such as the slurry will continue to absorb chlorine or hypochlorite and terminating said addition when the slurry will absorb no more chlorine or hypochlorite as evidenced by the presence of excess chlorine or hypochlorite in the slurry; and maintaining the thus chlorinated slurry at a temperature within the range of about 70° to 125° F. for a period of about 6 to 12 hours with the resulting production of a slurry the solids content of which is amenable to a least 75 weight percent extraction of the gold component thereof by standard cyanidation practice.

2. The method according to claim 1 in which the chlorinating agent is chlorine gas that is dispersed throughout the slurry at a rate and for a period of time such as the slurry will continue to absorb the chlorine, the addition of chlorine being terminated when the slurry no longer will absorb chlorine and a significant amount of unabsorbed chlorine is evolved from the slurry.

3. The method according to claim 2 in which the pH of the slurry is adjusted to 6.0 or lower after the addition of hypochlorite thereto.

4. The method according to claim 1 in which the chlorinating agent is sodium hypochlorite that is added to the slurry until the slurry will no longer absorb and react with the hypochlorite as evidenced by the presence of a significant amount of unabsorbed hypochlorite in the slurry.

5. The method according to claim 1 in which the chlorinating agent is calcium hypochlorite.

* * * * *